US007095291B1

(12) United States Patent
Kocharyan

(10) Patent No.: US 7,095,291 B1
(45) Date of Patent: Aug. 22, 2006

(54) RESONANT STRUCTURE AND METHOD FOR LUMPED ELEMENT IN NONRECIPROCAL DEVICE

(75) Inventor: Karen Kocharyan, Burlington, MA (US)

(73) Assignee: Renaissance Electronics Corporation, Harvard, MA (US)

( * ) Notice: Subject to any disclaimer, the term of this patent is extended or adjusted under 35 U.S.C. 154(b) by 46 days.

(21) Appl. No.: 11/067,352

(22) Filed: Feb. 28, 2005

(51) Int. Cl.
*H01P 1/383* (2006.01)

(52) U.S. Cl. ..... 333/1.1; 333/24.2

(58) Field of Classification Search ..... 333/1.1, 333/24.2
See application file for complete search history.

(56) References Cited

U.S. PATENT DOCUMENTS 5,153,537 A * 10/1992 Desmarest ..... 333/1.1

* cited by examiner

*Primary Examiner*—Stephen E. Jones

(57) ABSTRACT

A structure according to the present invention relates to the non-reciprocal microwave device such as circulator/isolator and includes the circuit, a ferrite member and a dielectric film. The circuit has three arms, each composed of two branches incorporating multiple strips. The branches are folded over a ferrite and isolated from each other by dielectric films to compose a multi-layer structure coupled with ferrite. The branches and strips are shaped to minimize the overall thickness of layer structure and to avoid triple crossover at intersections. The described assembly method allows maintaining symmetry between the ports of circulator/isolator. The broadband and high power operation of resonant structure is achieved by minimizing the asymmetry and improving the power distribution over the entire ferrite area.

6 Claims, 6 Drawing Sheets

RESONANT STRUCTURE AND METHOD FOR LUMPED ELEMENT IN NONRECIPROCAL DEVICE

CROSS-REFERENCE TO RELATED APPLICATIONS

Not Applicable

STATEMENT REGARDING FEDERALLY SPONSORED RESEARCH OR DEVELOPMENT

Not applicable

REFERENCE TO A MICROFICHE APPENDIX

Not Applicable

BACKGROUND OF THE INVENTION

The present invention relates to nonreciprocal devices, such as isolators and circulators, operating at relatively low microwave frequencies (approximately 50 MHz–1 GHz), in relatively high power systems (approx. 50 Watts and higher) and under broadband conditions. More specifically, the invention relates to the center conductor circuit (further referred to as a circuit) having a central junction and arms for lumped element circulator/isolator with three ports and method for forming a resonant structure when this circuit is assembled with a ferrite and an isolating material. Externally applied biasing magnetic field allows the resonant structure to act as either circulator or isolator (when one of the ports is terminated).

The circuits for lumped element devices are well-known (see, for example, U.S. Pat. No. 5,838,209). In the known circuits, three arms extended from a central junction and folded over a ferrite are disposed on the ferrite surface in such a way that they intersect each other at specified angles in electrically isolated conditions and a DC bias magnetic field is applied to the ferrite. The arms in the known circuits may consist of one or more strips that are parallel to each other.

Circulators are usually connected to 50 Ohm transmission lines while isolators have one port connected to a matched 50 Ohm termination. In order to minimize the reflection of RF power, each arm, when incorporated into the resonant structure, should have 50 Ohm impedance, which requires the entire system to be symmetrical. In terms of attaining symmetry, the most crucial features in resonant structure are shape of the arms and geometry of strip intersection. In the narrow-band devices, a small asymmetry and difference in the arm impedances are tolerable since they can be compensated by a conventional tuning. In some particular applications the arms can also be differently shaped to obtain the required performance at narrow band (see, for example, U.S. Pat. No. 6,614,324). The broadband operation, however, is realized on the condition of well maintained symmetry between the arms. To achieve the symmetry, the overlapping pattern at strip intersections and disposition of all strips with respect to the ferrite(s) should be identical, or, at least, have minimal differences.

The simplest circuit is one which consists of the arms each having only one strip. In such circuit all three folded arms/strips intersect simultaneously in the central area of a ferrite forming one triple crossover. To ensure the electrical isolation at intersection, the strips are sandwiched between the layers of low loss thin insulation, such as dielectric films of Maylar, Kapton, and alike. The major drawback of this design is that at triple crossover the distance between the ferrite and strips varies from one strip to another. It means that the electromagnetic coupling between the strips and the ferrite varies from one strip to another as well, and because of that, the electrical characteristics of resonant structure become asymmetrical. Also, in a triple crossover area, the strip situated in a middle of the crossover becomes obstructed from the ferrite by two adjacent strips. This situation also contributes to the asymmetry. Another shortcoming of a single strip design is that the RF field associated with the strips is not uniform, but concentrated predominantly in the ferrite central area where the strips meet each other. To diminish the asymmetry and produce more uniform RF field the conventional design utilizes the circuits having more than one strip (typically two) at each arm. Two strips per arm being folded produce four intersections in each individual strip and twelve intersections in total. Conventionally, the resonant structure is formed by folding all strips of the same arm simultaneously. Because of multiple crossovers, the field distribution over the ferrite improves; however, triple intersections can stay. Therefore, device in operation becomes asymmetrical for the same reason as it was described for a single strip structure. The asymmetry can be reduced by folding the strips separately (weaving). This procedure reduces asymmetry by inverting the disposition of the strips at each consecutive intersection. But it also slows dawn the production process as the number of strips to be weaved increases.

With the increase of RF power passing through a device, avoiding a local overheating becomes more important. This can be done by distributing the RF field more evenly over the entire ferrite area. The uniformity of RF field can be achieved by increasing the number of strips in the arms. Increasing the number and width of the strips improves also the matching and broadband performance as the frequency decreases below 1 GHz.

Increasing the number of strips while using conventional folding methods leads also to the development of plurality of triple-intersection areas. For better performance, it is desirable to avoid all triple crossover areas at intersections, as they directly contribute to the development of asymmetry. If, for the symmetry reason, conventionally designed strips are folded and isolated separately, a dramatic increase of the layers of sandwich structure develops as number of strips in arms increases. With the increase of the number of layers and overall thickness some strips become positioned farther from the ferrite and, consecutively, become less coupled with resonant structure, thus decreasing the bandwidth and degrading the nonreciprocal action of circulator/isolator. As seen from above, the best high-power and broadband performance of lumped-element circulators and isolators can be achieved only if the increase in number of strips does not spoil the symmetry of arms and degrade the coupling between strips and the ferrite.

Accordingly, what is needed is a thin symmetrical multi-strip resonant structure for lumped element device wherein only two strips overlap at each intersection point, and a method for providing such structure. Such resonant structure, when used in nonreciprocal devices like circulator/isolator, has to provide adequate heat dissipation in relatively high power operation that is big enough electromagnetic field distribution area. Also, such resonant structure has to adequately operate within broadband conditions and at the frequency range less than 1 GHz.

BRIEF SUMMARY OF THE INVENTION

The present invention relates to a circuit of resonant structure for a nonreciprocal device such as circulator/isolator, which has 120-degree symmetry. The device also includes a ferrite, an insulation, and an outside source of the bias magnetic field. Depending on application, the device may also include housing or ground planes, pole pieces, temperature compensators, connectors, PCB and other elements which are usually used in a circulator/isolator design. The outside source of the bias magnetic field and other conventional elements of circulator/isolator structure (except the ferrite and the insulation) are not discussed in the present disclosure.

The resonant structure according to the present invention comprises a circuit, an insulation and a ferrite (which in operation has to be biased by magnetic field). The circuit is shaped to have a symmetrical polygonal (for example, hexagonal) central junction and three arms. The arms extend sidewise from the central junction at 120 degree with respect to each other. Every arm includes the same plurality of branches, two in the preferable embodiment. Every branch includes strips, preferably not less than two. If by calculation only one strip per branch is needed, then the terms of branch and strip will denominate the same part of the circuit and became interchangeable. Gaps between the strips and branches in the arm are equal to each other and identical for all arms in the circuit. In the preferable embodiment the strips and the branches are also identical in all arms. In this embodiment the median line drawn in the polygonal central junction bisects the gap between the branches. The gaps between branches/strips are at least two times as wide as the strips. On top of the central junction a ferrite of substantially the same shape as the junction but slightly bigger in size is situated. The stripes of the same branch are folded simultaneously over the ferrite and isolated from each other with very thin films of a dielectric material (for example, "Kapton" of 0.5 mil thick) sandwiched between them.

With the proposed structure and method of its assembly, the resonant structure does not have triple crossovers at any point, has less number of layers and accordingly has minimal overall thickness, provides maximum symmetry and, because of that, provides the best conditions for broadband and high power operation.

It is an object of the present invention to have a resonant structure for a nonreciprocal broadband device, such as circulator/isolator, operating at relatively low frequencies (lower than 1 GHz) and high power (more than 50 Watts) which provides equal impedances at all arms, has good heat dissipation characteristics and effective method of assembly.

It is further object of the present invention to have mechanically simple and sound resonant structure which provides minimal overall thickness and maximum symmetry.

It is an advantage of the present invention to have a resonant structure which is easily calculable to be of optimal geometric parameters.

DETAIL DESCRIPTION OF THE INVENTION

Figure 1:
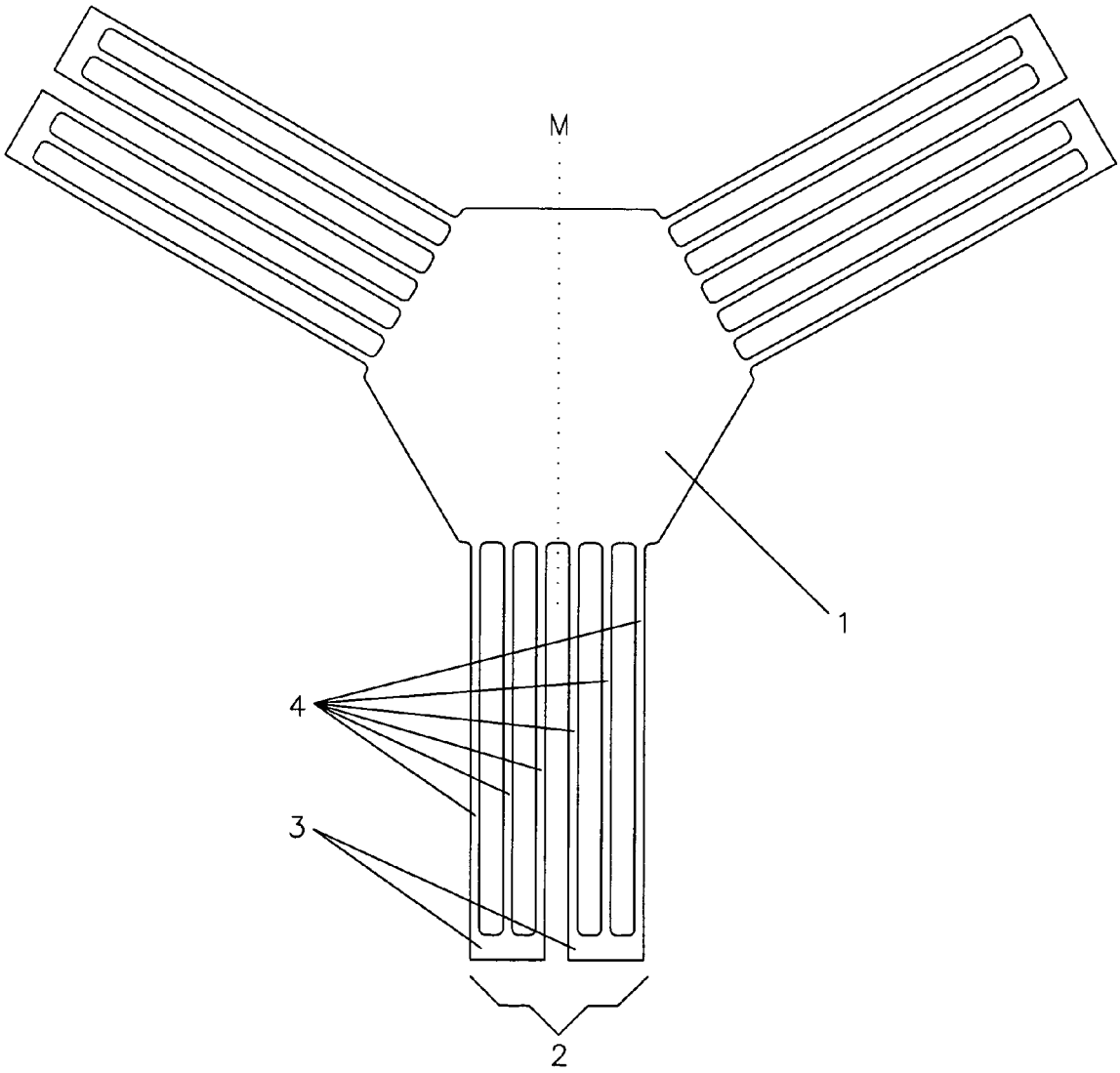
FIG. 1 shows the circuit according to the present invention with hexagonal central junction and multi-strip double branch arms, all situated in the same plane (the circuit is flat) and ready for the lump element assembly process. Letter M denotes a median (shown in dotted line) in central junction.

Referring to FIG. 1, the flat circuit (before folding) of resonant structure in accordance with the main embodiment of the present invention comprises multi-sided symmetrical central junction 1 and three identical arms 2 symmetrically extending from three sides of the junction 1 at 120-degree angle to each other. Every arm 2, has two identical branches 3, and every branch 3, in turn, has a plurality of identical strips 4. The width of all strips 4 is the same. All gaps between the strips 4 and the branches 3 are also identical. According to the present invention, there is a specific ratio between the widths of the strips 4 and the gaps (will be considering later).

Figure 2:
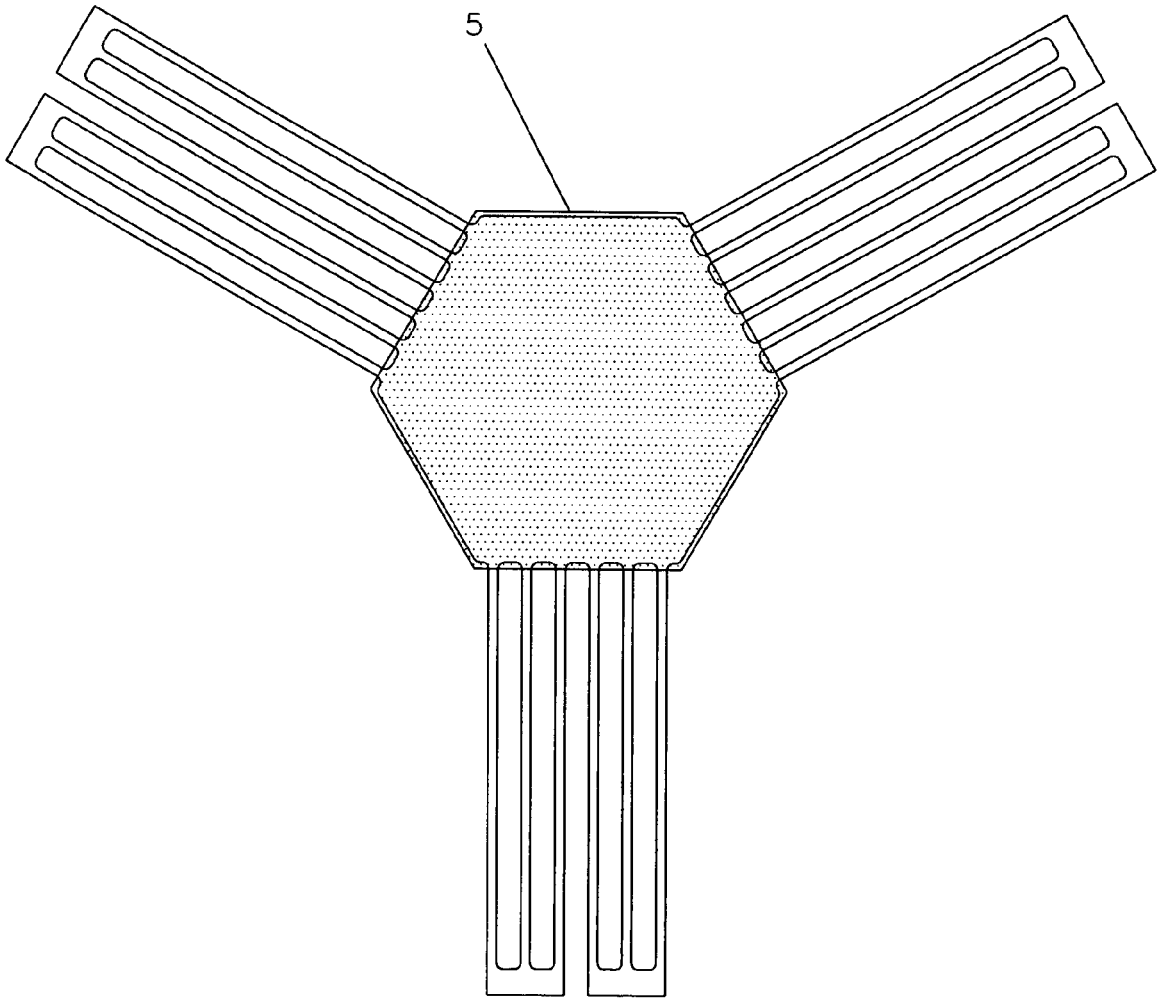
FIG. 2 shows a ferrite (shaded with dots) being centrally located on top of the flat circuit as a first step of the assembly process in accordance with the present invention.

Before starting the assembly process the circuit is flat, as shown in FIG. 1. Referring to FIG. 2, in the first step of the assembly process a ferrite 5 (shaded with dots) should be disposed on top of the central junction 1 in a way where their geometrical centers coincide and sides are parallel to each other. The ferrite 4 has basically the same shape as the central junction 1, but is slightly larger in size than the central junction. This larger size allows the branches 3 to be easily folded over the ferrite at the next steps of the assembly process shown in FIG. 3 and FIG. 4. Since the strips 4 have much smaller cross-section area to be bent compare with the central junction 1, it makes bending conditions more favorable and bending process less stressful for the ferrite.

Figure 3:
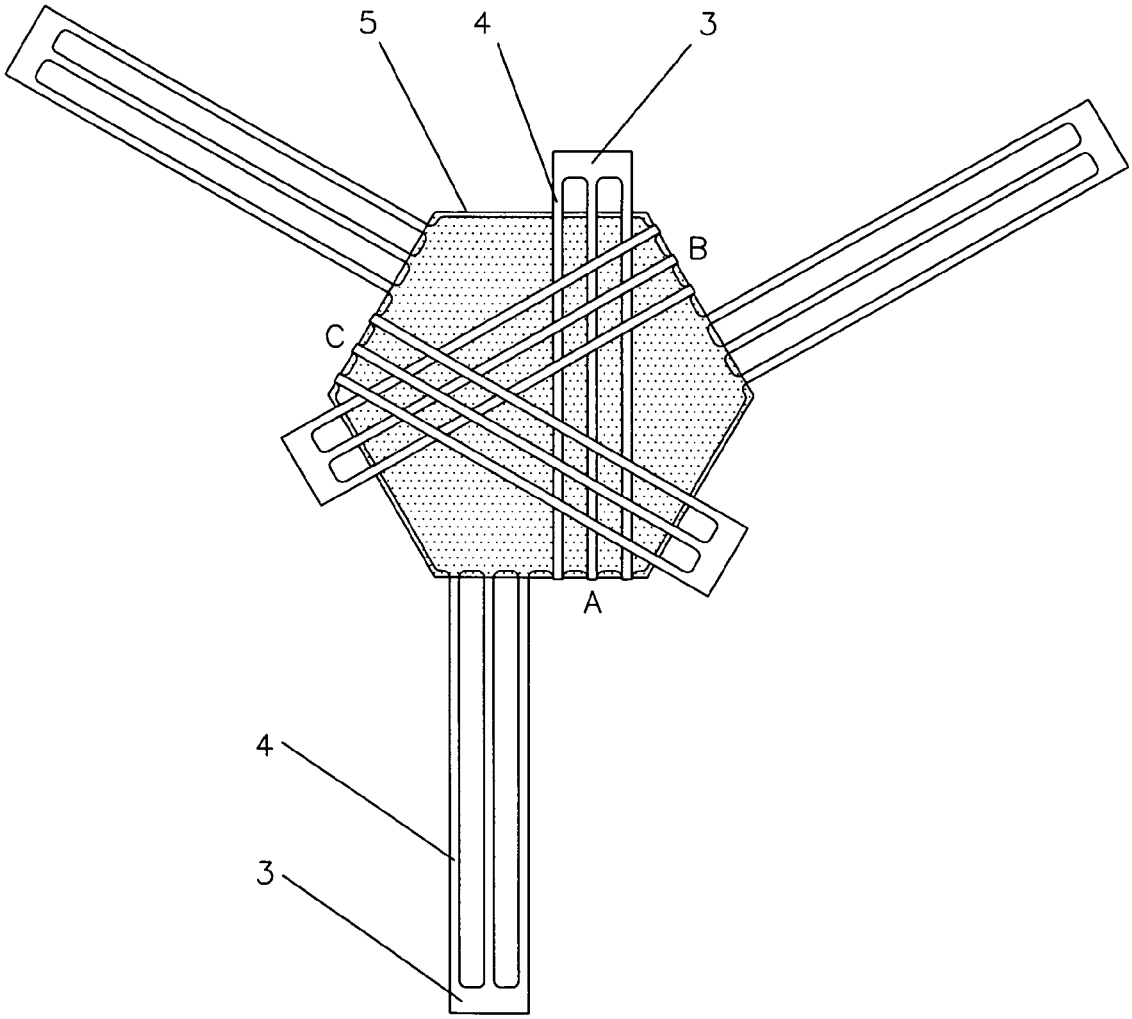
FIG. 3 shows the first stage of the process of folding branches over the ferrite, wherein the right-side (to FIG. 2) branches of the arms were chosen to be initially folded in chosen direction (counter clockwise). Letters A, B and C alphabetically denote the sequence of branch folding.
Figure 4:
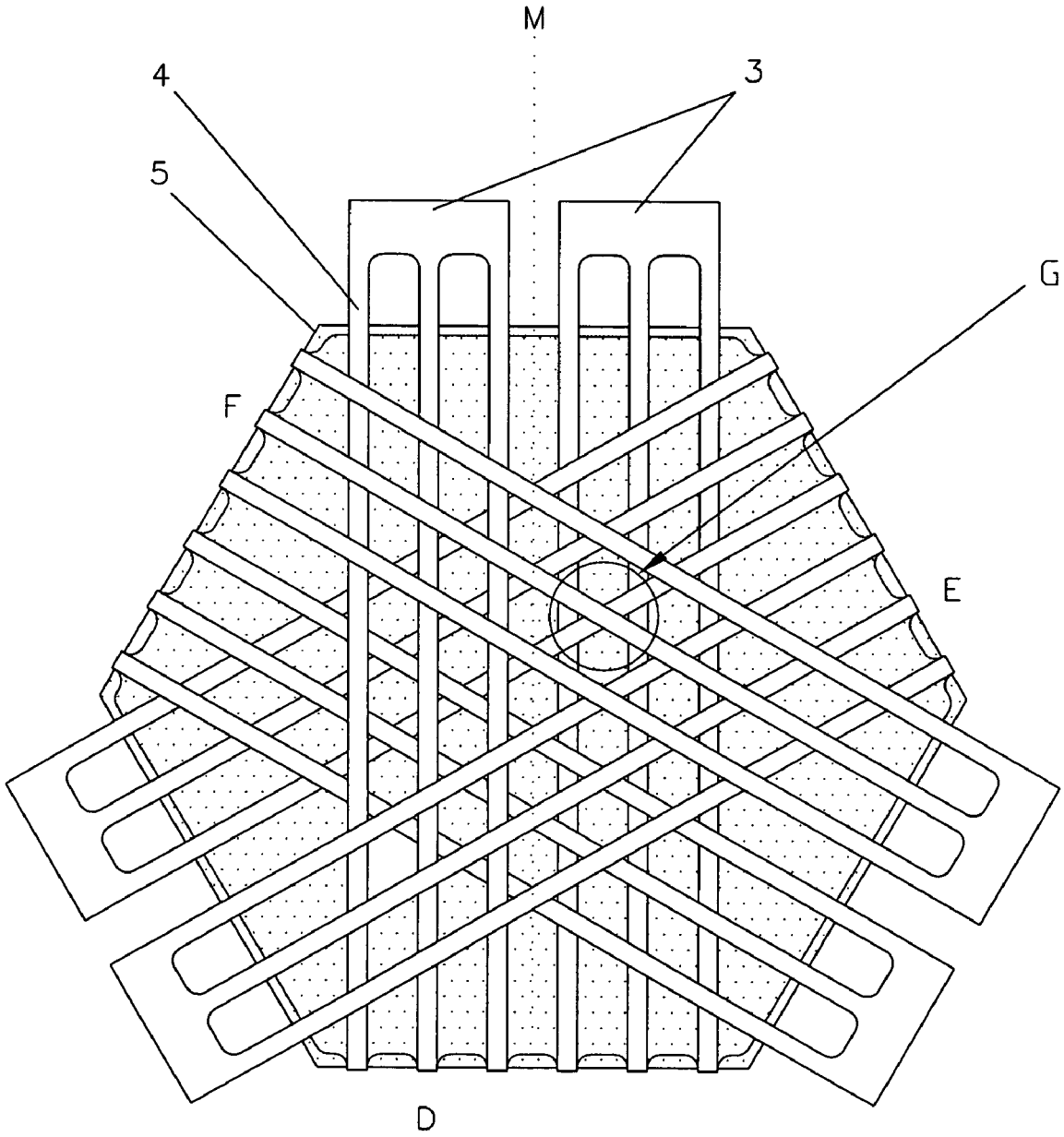
FIG. 4 shows in enlarged picture the second (final) stage of the process of folding branches over the ferrite, where letters D, E and F alphabetically denote the sequence of branch folding.

According to the present invention, the best performance of resonant structure in terms of symmetry and impedance matching is achieving with some given quantity of strips 4 and given ratio between the widths of strips 4 and gaps between them, as well as the sequence of folding the branches 3. In the preferable embodiment of the present invention which is disclosing here, there are two branches 2 at each arm-side (the side where arms are situated) of the polygonal central junction 1. With this circuit configuration, the sequence of folding the branches 3 which allows weaving the strips 4 and, accordingly, makes the resonant structure symmetrical is as follows. First, the branch 3 situated in A position of arm 2 in FIG. 3 is folded over the ferrite and a dielectric film (not shown) is placed over the folded branch. Then, the branch 3 in B position is folded and isolated with dielectric film and after that the branch 3 in C position is folded and isolated. In other words, every other branch 3 in any chosen branch folding sequence (in counter clockwise direction as for illustration purposes is shown in FIG. 3) is to be bent. Similarly, the other three branches disposed in positions D, E and F are also folded following the same direction and folding sequence (as shown in FIG. 4). All branches 3, while being folded, are isolated from each other with thin layer of dielectric (not shown), for example, Kapton of 0.0005" thick (as in many conventional lumped element circuits).

Figure 5:
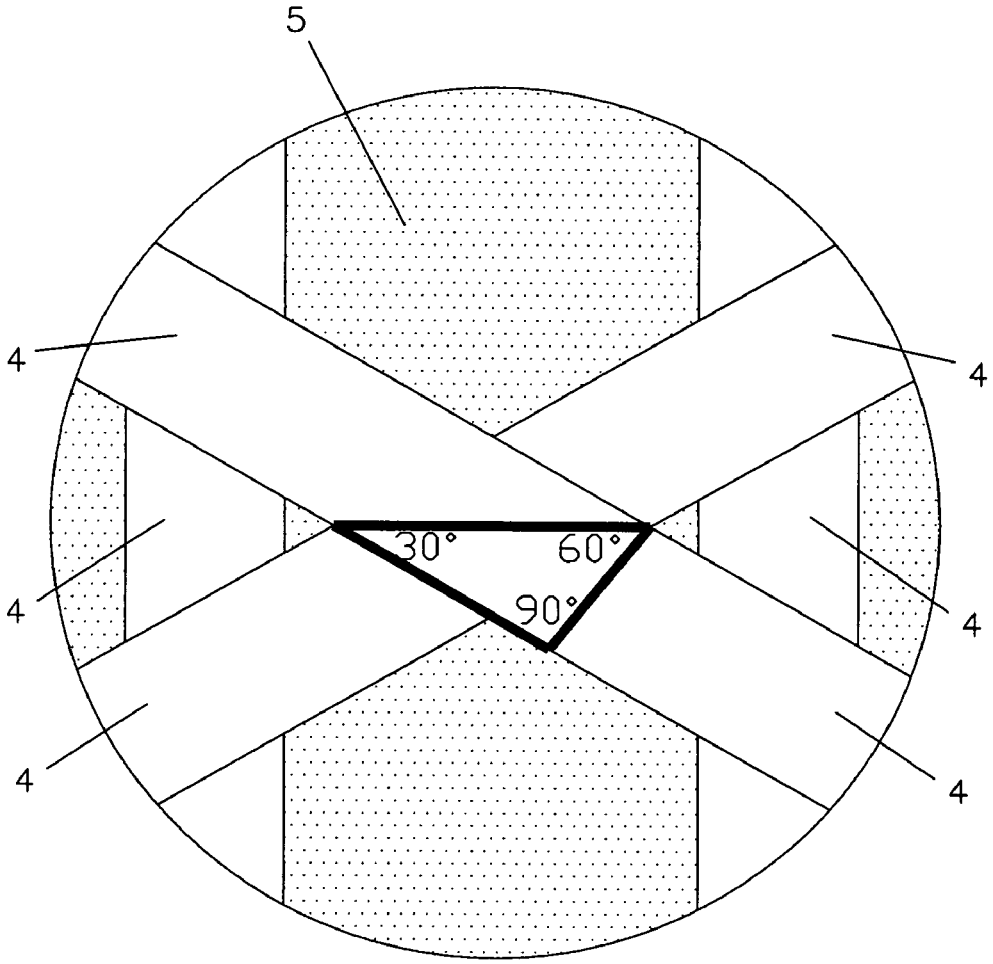
FIG. 5 shows the enlarged portion G to FIG. 4.

The required relationship between the width of the strips 4 and gaps between them, in accordance with the present invention, can be found from consideration of the strip intersection area shown in FIG. 5. It is obvious that at 120-degree intersection of any two strips 4 one can construct a right-angle triangle as shown in FIG. 5. The hypotenuse in this triangle shows how far a double intersection area extends in the longest direction. The side opposite to the 30-degree angle in that triangle represents the width of the strip 4. It is known from geometry that in a right-angle triangle the side opposite to a 30-degree angle is equal to the half length of hypotenuse. From FIG. 5 it is clear that, in order to avoid a triple crossover, the width of the gap should be more or, at least, equal to the length of double intersection area, which is a hypotenuse of the triangle. So, the width of the gap should be at least twice larger than the width of the strip 4.

In order to reduce the number of layers in resonant structure the present invention proposes grouping the strips 4 of each arm 2 into branches 3 (two branches 3 in each arm 2 are considered in the present disclosure). Each branch 3, in turn, contains two or more strips 4 (three strips in the present disclosure). The strips 4 of the same branch 3 are electrically connected together at the far ends from the central junction 1. This makes the number of branches 3 at any given side of the central junction 1 equal to two. While folding the strips 4, every branch 3 is treated as a single entity because the strips 4 of the same branch 3 are connected and folded simultaneously. Gaps between the strips 4 and branches 3 have to be at least twice wider than width of the strips 4. Because of this, triple crossovers are avoided as seen from above.

The present invention allows significantly reduce the number of layers and labor involved in the assembly process by eliminating the necessity of folding and insulating each individual strip separately. For example, according to the conventional designs, the circuit having six strips at each arm would have eighteen layers of strips and seventeen layers of isolation, while the proposed design allows reducing these numbers to six layers of strips and five layers of insulation.

For obtaining the geometrical symmetry the gap between two branches 3 at the same side of the central junction 1 has to be in the middle of that side. In other words, a median M of the central junction 1 (shaped as hexagon in this disclosure) and longitudinal center line of the gap between the branches shall constitute a continuation of one another at each arm 2. Because minimal number of strips 4 at each arm 2 is two, adding to arms 2 symmetrically new strips 4 will always keep their number even.

Figure 6:
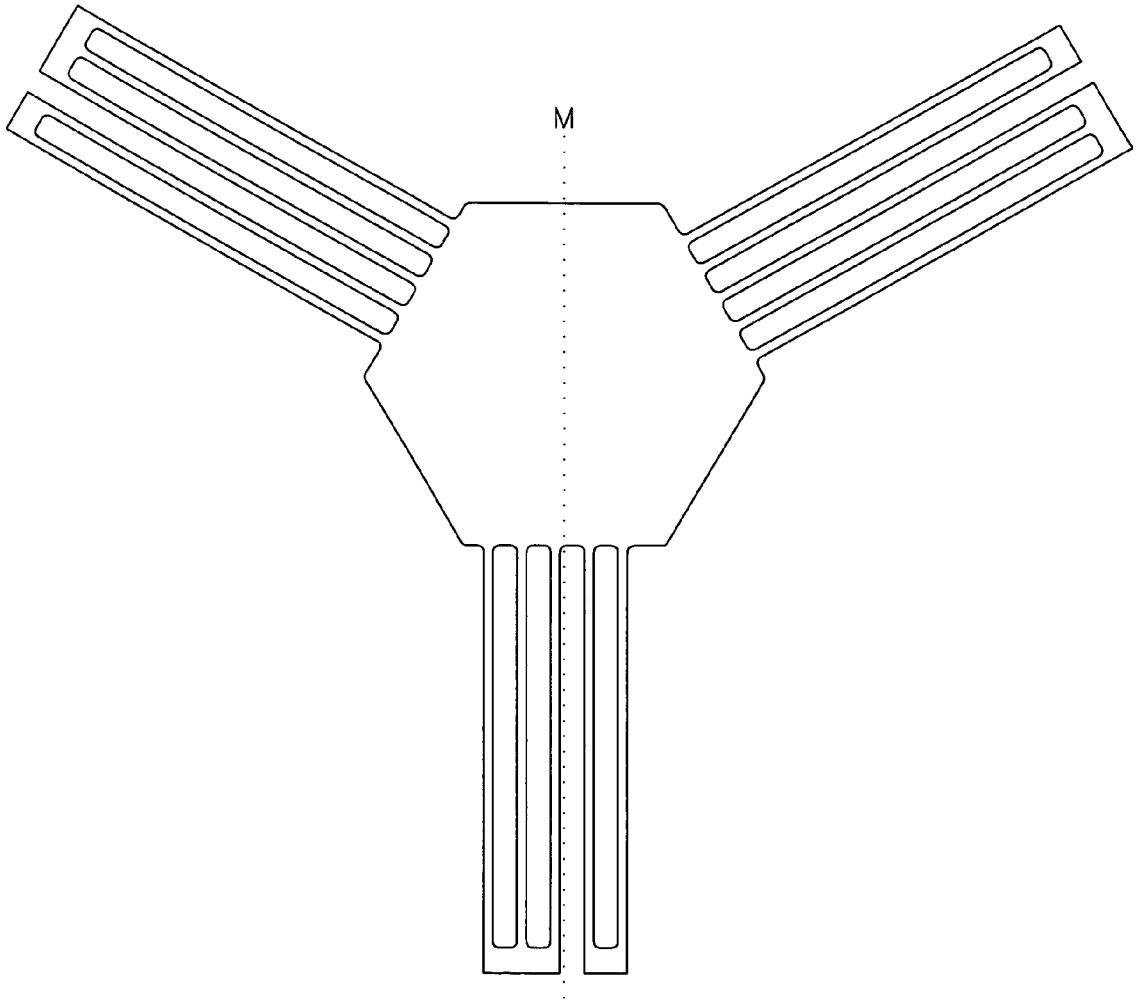
FIG. 6 shows another embodiment of the present invention wherein the number of strips in branches of the same arm is different. It also depicts a condition where median M shall be within the gap between the branches.

A possibility, however, exists that for some particular frequency bands and ferrite dimensions the impedance matching will require the odd number of strips per arm. That embodiment shown in FIG. 6 is also considered to be within the scope of the present invention on the conditions that the median line M of the central junction 1 falls within a gap between the branches, and the relative disposition of smaller and larger branches remains the same at each arm. With such configuration the mirror symmetry with respect to the median line M at the arms will be destroyed. However the 120° symmetry for the central junction 1 and overall resonant structure will be preserved.

In the method according to the present invention, symmetry of the resonant structure is achieved by folding and insulating the branches 3 in sequential order according to a randomly chosen direction (clockwise or counter clockwise) starting from the branches 3 located at one side of the arms 2 and proceeding with the branches 3 on the other side of the arms 2 (for example, first are consecutively folding and insulating the branches 3 located at the right-hand side of the arms 2 and then are consecutively folding and isolating the branches 3 at the left-hand side of the arms 2).

The method of assembling of resonant structure includes the steps of centrally disposing a ferrite on the central junction, folding the left/right (depending on a chosen direction) branch of the first arm over the ferrite, disposing a dielectric film (insulation) over the first folded branch, folding the left/right branch of the second arm over the ferrite, disposing a dielectric film on top of the second folded branch, folding the left/right branch of the third arm over the ferrite, disposing a dielectric film on top of the third folded branch, folding the right/left branch of the first arm over the ferrite, disposing a dielectric film on top of the forth folded branch, and so on.

While the preferred embodiment of the invention was described in detail, it is clear that there are variations and modifications to this disclosure here and above which will be readily apparent to one of ordinary skill in the art. To the extent that such variations and modifications of the present disclosure of resonant structure are intended improving the power handling capacities and extending the bandwidth of lumped element device by:

minimizing the thickness of multi-strip structure by combining the strips of each arm into branches, and improving symmetry of arms by weaving the branches in chosen order and direction, and avoiding the triple crossover areas, such are deemed within the scope of the present invention.

I claim:

1. A resonant structure for lumped element in nonreciprocal device, comprising:

a circuit including a central junction and arms;

a ferrite;

dielectric films wherein said ferrite having basically the same shape as said central junction and folded over by said arms which laterally extend from said central junction at 120-degree relative to each other and each includes at least two branches, every said branch being folded is isolated from each other by a said dielectric film, every said branch having plurality of strips parallel to each other, all said strips having the same width, and all gaps between said branches in said arms and all gaps between said strips within each said branches having the same width which is at least twice as wide as the width of said strips.

2. A resonant structure as recited in claim 1, wherein said central junction having a polygonal symmetrical shape and three sides with said arms situated at 120-degree to each other.

3. A resonant structure as recited in claim 1, wherein quantity of said strips at all said arms are even and the same in all said branches, and a median line drawn in said polygonal central junction bisects the gap between said branches.

4. A resonant structure as recited in claim 1, wherein quantity of said strips at all said arms are odd and different in said branches at one given side of said polygonal central junction and a median line drawn in said central junction is situated within said gap between said branches.

5. A resonant structure as recited in claim 1, wherein said ferrite having basically the same shape as said central junction but a little larger in size, their geometrical centers are coincide and sides are parallel to each other.

6. An assembly process of the resonant structure to claim 1 including steps of:

positioning said ferrite on said central junction;

folding first said branch over said ferrite:

positioning first said dielectric film on first said branch;

folding second said branch over said ferrite and first said dielectric film;

positioning second said dielectric film on second said branch;

folding consequently all said branches and locating all said dielectric films between them, wherein geometrical centers of said ferrite and said central junction coincide and all their sides are parallel to each other, and said branches are folded over sequentially in randomly chosen direction and order one at a time at each side of said central junction.

* * * * *